US008342597B2

(12) United States Patent
Nagami et al.

(10) Patent No.: US 8,342,597 B2
(45) Date of Patent: Jan. 1, 2013

(54) WORK VEHICLE EQUIPPED WITH REAR MONITORING CAMERA APPARATUS

(75) Inventors: Kouji Nagami, Hirakata (JP); Makoto Yomogita, Hirakata (JP); Masamichi Miyazaki, Hirakata (JP); Jun Matsumoto, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/391,500

(22) PCT Filed: Aug. 11, 2011

(86) PCT No.: PCT/JP2011/068352

§ 371 (c)(1),
(2), (4) Date: Feb. 21, 2012

(87) PCT Pub. No.: WO2012/020823

PCT Pub. Date: Feb. 16, 2012

(65) Prior Publication Data

US 2012/0146361 A1 Jun. 14, 2012

(30) Foreign Application Priority Data

Aug. 11, 2010 (JP) ..... 2010-180082

(51) Int. Cl.
*B62D 33/06* (2006.01)

(52) U.S. Cl. ..... 296/190.09; 62/239

(58) Field of Classification Search ..... 296/190.08, 296/190.09; 62/239, 509

See application file for complete search history.

(56) References Cited

U.S. PATENT DOCUMENTS

| | | | | |
|---|---|---|---|---|
| 7,347,488 | B2 * | 3/2008 | Hayes et al. | 296/190.08 |
| 7,606,648 | B2 * | 10/2009 | Shepherd et al. | 701/50 |
| 2006/0207275 | A1 * | 9/2006 | Janeling | 62/239 |

FOREIGN PATENT DOCUMENTS

| | | | |
|---|---|---|---|
| JP | 1-147135 U | | 10/1989 |
| JP | 9-28109 A | | 2/1997 |
| JP | 2000062653 | * | 2/2000 |
| JP | 2009-96222 A | | 5/2009 |

* cited by examiner

*Primary Examiner* — Dennis Pedder
(74) *Attorney, Agent, or Firm* — Global IP Counselors

(57) ABSTRACT

A work vehicle includes a cab, an air conditioner casing, an air conditioner unit and a rear monitoring camera. The air conditioner casing is attached to a rear upper part of the cab and includes a downwardly opened recess on a bottom face thereof. The air conditioner unit is accommodated in the air conditioner casing. The rear monitoring camera includes a main body accommodated in the recess of the air conditioner casing.

6 Claims, 6 Drawing Sheets

WORK VEHICLE EQUIPPED WITH REAR MONITORING CAMERA APPARATUS

CROSS-REFERENCE TO RELATED APPLICATIONS

This application claims priority to Japanese Patent Application No. 2010-180082 filed on Aug. 11, 2010, the disclosure of which is hereby incorporated herein by reference in its entirety.

BACKGROUND OF THE INVENTION

1. Field of the Invention

The present invention relates to a work vehicle equipped with a rear monitoring camera apparatus for monitoring the back thereof.

2. Background Art

Some of the well-known work vehicles of the type (e.g., bullozers) include an air conditioning device (hereinafter simply referred to as "an air conditioner") attached to the rear part of a cab (for example, see Japanese Patent Application Laid-Open 2009-096222A).

The aforementioned work vehicles are assumed to be equipped with a rear monitoring camera for monitoring the back thereof, and the rear monitoring camera can be disposed on the bottom or rear face of the rear part of the air conditioner.

However, a drawback is produced when the rear monitoring camera is disposed on the bottom face of the rear part of the air conditioner, because the rear monitoring camera itself blocks a field of view of an operator in the cab when the operator looks back through a rear window.

A drawback is also produced when the rear monitoring camera is disposed on the rear face of the rear part of the air conditioner, because the rear monitoring camera may be damaged by the contact with external obstacles.

SUMMARY

The present invention has been produced in view of the aforementioned drawbacks. It is an object of the present invention to provide a work vehicle equipped with a rear monitoring camera apparatus having less chances of damage by external obstacles without blocking a rear field of view.

A work vehicle according to a first aspect of the present invention includes a cab, an air conditioner casing, an air conditioner unit and a rear monitoring camera. The air conditioner casing is attached to a rear upper part of the cab. The air conditioner casing includes a downwardly opened recess on a bottom face thereof. The air conditioner unit is accommodated in the air conditioner casing. The rear monitoring camera includes a main body accommodated in the recess of the air conditioner casing.

According to the work vehicle of the first aspect of the present invention, at least the main body of the rear monitoring camera is accommodated within the blower part cover. Therefore, the rear monitoring camera does not block a rear view compared to the structure that the entire rear monitoring camera is downwardly protruded from the blower part cover. Further, it is possible for the rear monitoring camera to have less chances of damage by external obstacles compared to the structure that the entire rear monitoring camera is protruded from the rear part of the blower cover.

A work vehicle according to a second aspect of the present invention relates to the work vehicle according to the first aspect of the present invention. The work vehicle further includes a condenser and two cooling fans. The condenser is accommodated in the air conditioner casing while being disposed along a transverse direction of the work vehicle. The cooling fans are accommodated in the air conditioner casing while being disposed adjacent to each other in the transverse direction. Further, the air conditioner casing includes a blower part cover. The blower part cover covers rear sides of the cooling fans. The blower part cover forms a wind flow path for blown wind from the cooling fans. Yet further, the recess is disposed in the blower part cover.

A work vehicle according to a third aspect of the present invention relates to the work vehicle according to the second aspect of the present invention. In the work vehicle, the blower part cover includes a wind shielding cover for shielding against the blown wind from the cooling fans. The wind shielding cover herein forms an inner wall of the recess. Further, the wind shielding cover is disposed in a clearance between the cooling fans without being overlapped with the cooling fans when the air conditioner casing is transparently seen from a rear side thereof.

According to the work vehicle of the third aspect of the present invention, the rear monitoring camera is disposed between the cooling fans. Therefore, the rear monitoring camera does not block the flow of the blown wind from the cooling fans. Further, the blown wind, heated as a result of heat exchange with the condenser, does not directly hit the rear monitoring camera. Consequently, it is possible to inhibit reduction in the flow amount of the blown wind and elevation in temperature of the rear monitoring camera.

A work vehicle according to a fourth aspect of the present invention relates to the work vehicle according to the third aspect of the present invention. In the work vehicle, each of the cooling fans includes a rotation shaft disposed along a longitudinal direction of the work vehicle. Further, the rear monitoring camera is positioned lower than the rotation shafts of the cooling fans in a vertical direction of the work vehicle while being disposed in the middle of the rotation shafts of the cooling fans in the transverse direction.

According to the work vehicle of the fourth aspect of the present invention, it is possible to further inhibit reduction in the flow amount of the blown wind from the cooling fans.

A work vehicle according to a fifth aspect of the present invention relates to the work vehicle according to one of the third and fourth aspects of the present invention in the work vehicle, the rear monitoring camera is attached to the wind shielding cover through an anti-vibration rubber.

According to the work vehicle of the fifth aspect of the present invention, the anti-vibration rubber can inhibit not only vibration transmission from the cab to the rear monitoring camera but also thermal transmission from the wind shielding cover warmed due to the impact of the blown wind from the cooling fans to the rear monitoring camera. Further, an air layer is formed in a clearance between the wind shielding cover and the rear monitoring camera by the anti-vibration rubber interposed therebetween. Therefore, it is possible to more reliably inhibit elevation in temperature of the rear monitoring camera.

Overall, according to the present invention, it is possible to provide a work vehicle equipped with a rear monitoring camera apparatus disposed and structured to be less damaged by external obstacles without blocking a rear field of view.

DETAILED DESCRIPTION OF THE EMBODIMENTS

Next, a work vehicle including a support structure for a rear monitoring camera apparatus according to an embodiment of the present invention will be hereinafter specifically explained with reference to the attached drawings. It should be noted that the present invention is applied to a bulldozer as a work vehicle in the following example. However, applications of the present invention are not limited to the bulldozer.

Explanation of Schematic Structure of Bulldozer

Figure 1:
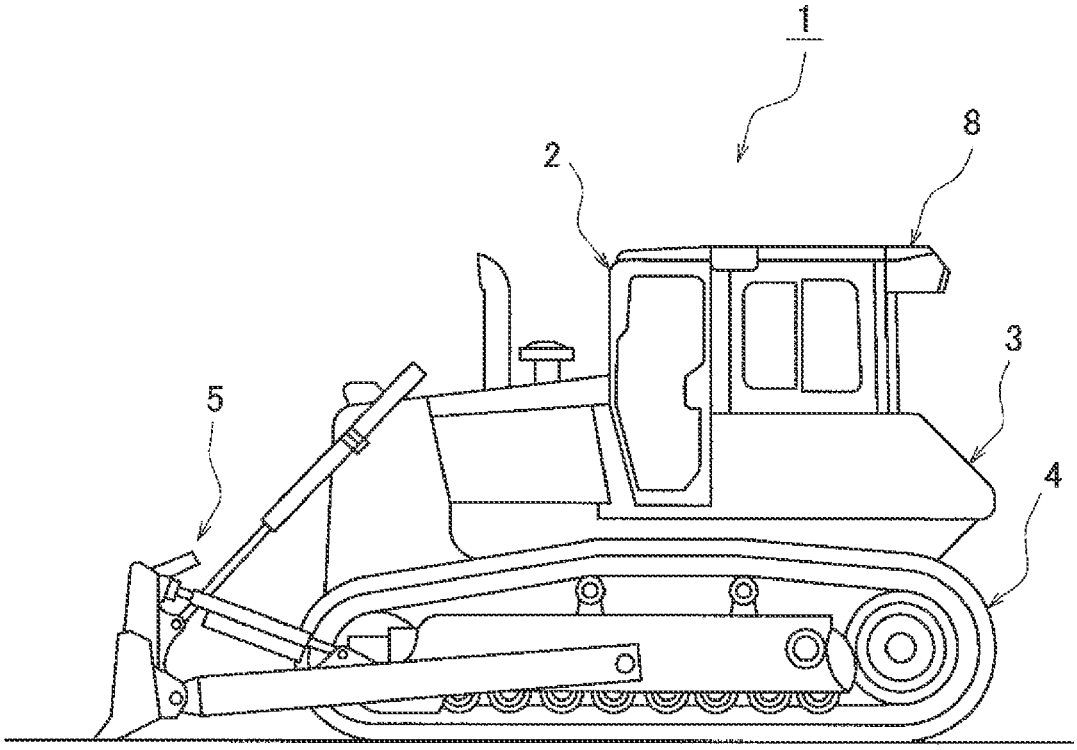
FIG. 1 is an entire side view of a bulldozer as an exemplary work vehicle according to an embodiment of the present invention.

A bulldozer 1 illustrated in FIG. 1 includes a vehicle body 3 which is embedded with a cab 2 forming an operator's room, a drive unit 4 which is a track-type drive unit including a pair of tracks (only a left-side track is illustrated in the figure) disposed on the both lateral sides of the vehicle body 3, and a front work implement (blade device) 5 which is disposed on the front side of the vehicle body 3.

Explanation of Air Conditioner

Figure 2:
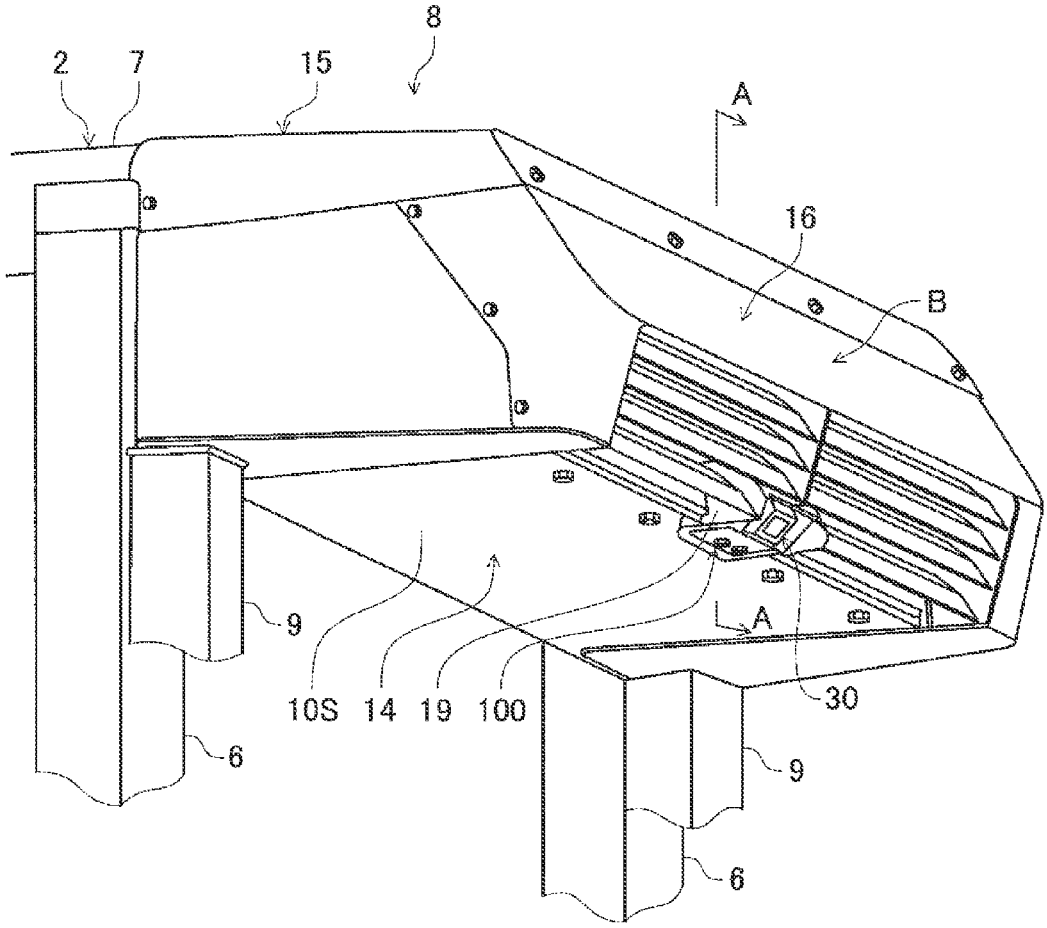
FIG. 2 is an entire perspective view of an air conditioner.

As illustrated in FIG. 2, an air conditioning device 8 is attached to the rear upper part of the cab 2 while being backwardly bulged from a pair of right and left rear pillars 6 and a ceiling member 7.

It should be noted in FIG. 2 that a reference numeral 9 is assigned to a pair of protective covers for protecting piping and its related components connected to the air conditioner 8.

Figure 3A:
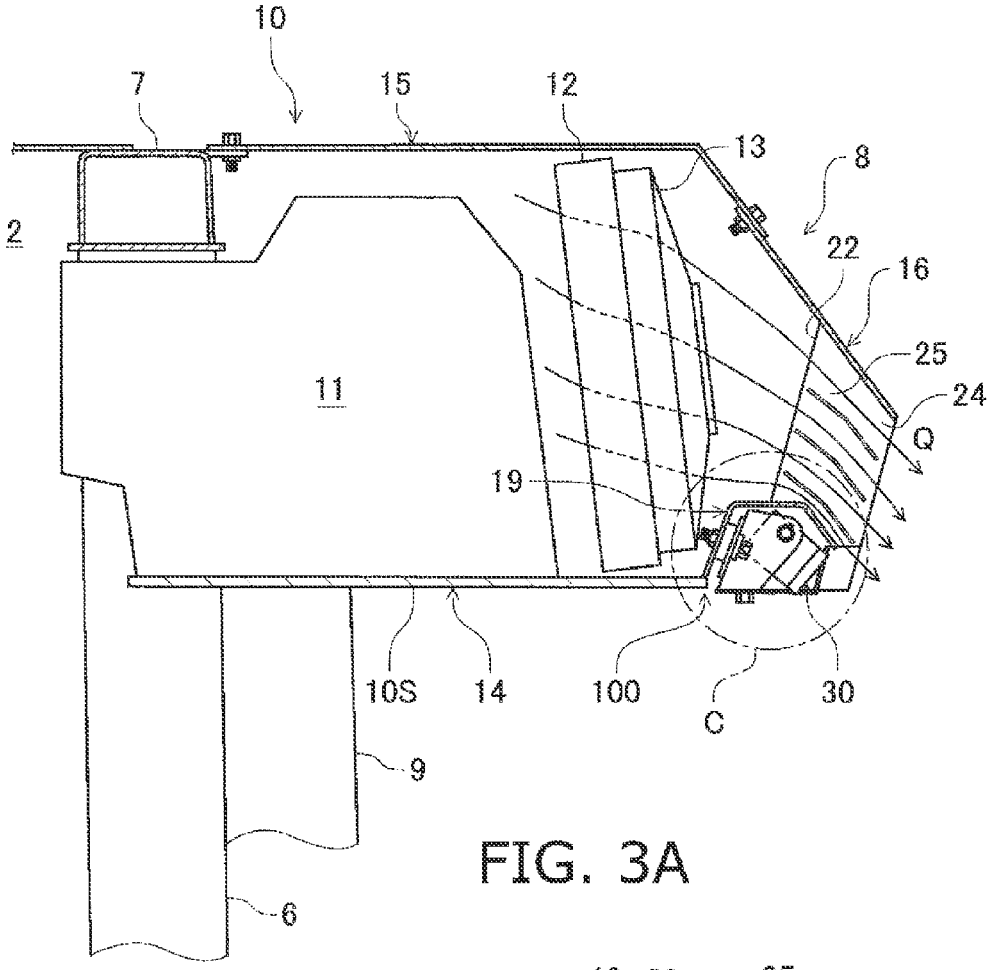
FIG. 3A is an A-A cross-section of FIG. 2.

As illustrated in FIG. 3A, the air conditioner 8 includes an air conditioner casing 10 and components accommodated therein including an air conditioner unit 11, a condenser 12 and a cooling fan 13.

Explanation of Air Conditioner Unit

The air conditioner unit 11 is disposed within the air conditioner casing 10 while being allowed to be communicated with the indoor and the outdoor of the cab 2. The air conditioner unit 11 is formed by incorporating a variety of devices (e.g., an indoor/outdoor air switching damper, a blower, an evaporator, a heater core and an air mix damper) into a housing all together.

Explanation of Condenser

The condenser 12 is disposed within the air conditioner casing 10 while being positioned rearwards of the air conditioner unit 11. The condenser 12 is a device configured to produce liquid refrigerant by condensing gas refrigerant of high temperature and high pressure to be supplied from a compressor (not illustrated in the figures). The liquid refrigerant produced by the condenser 12 is configured to be supplied to the evaporator disposed within the air conditioner unit 11 through an expansion valve (not illustrated in the figures). A refrigeration cycle is thus formed in which the refrigerant circulates through the compressor, the condenser 12, the expansion valve and the evaporator.

Explanation of Cooling Fan

Figure 4:
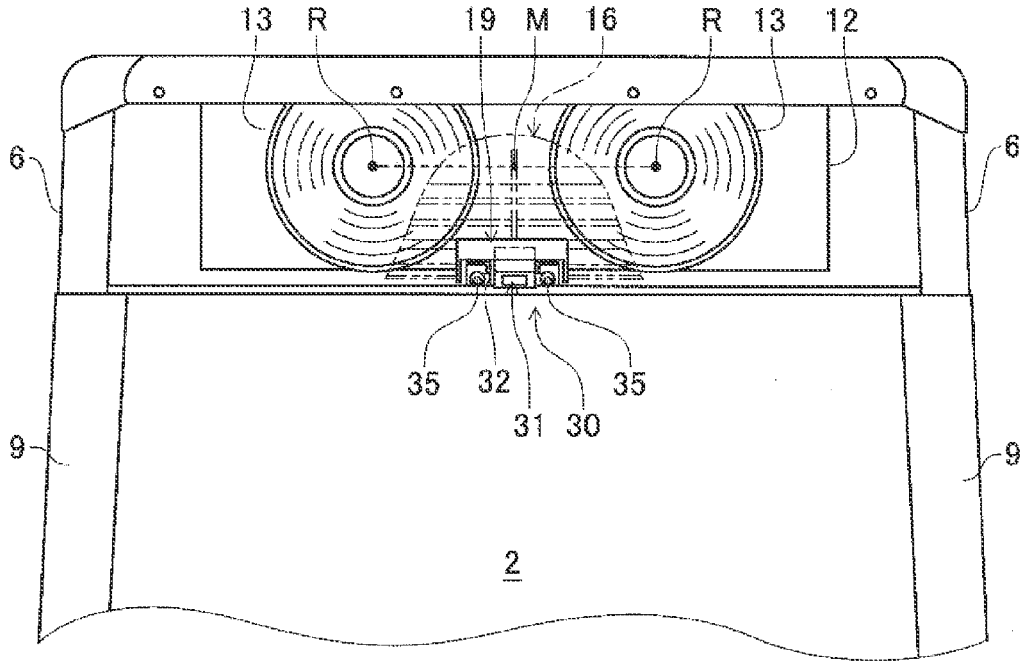
FIG. 4 is an explanatory arrangement diagram of a rear monitoring camera apparatus seen in a direction of an arrow B of FIG. 2 where a blower part cover is transparently illustrated.

The condenser 12 produces heat in condensing the refrigerant, so the condenser 12 is required to be cooled down. As illustrated in FIG. 4, two sets of cooling fans 13 are attached to the rear face of the condenser 12 for cooling down the condenser 12. The cooling fans 13 are adjacently disposed at a predetermined interval in a width direction (i.e., a transverse or right-and-left direction of a work vehicle) of the condenser 12. Each of the cooling fans 13 includes a rotation shaft R disposed on the center thereof along a back-and-forth direction of the work vehicle (i.e., the bulldozer 1). As illustrated in FIG. 3A, blown wind Q is produced in activating the cooling fans 13, and the blown wind Q is blown out to the rearward of the cooling fans 13 while flowing through the condenser 12 from the front to the back thereof.

Explanation of Air Conditioner Casing

Figure 5:
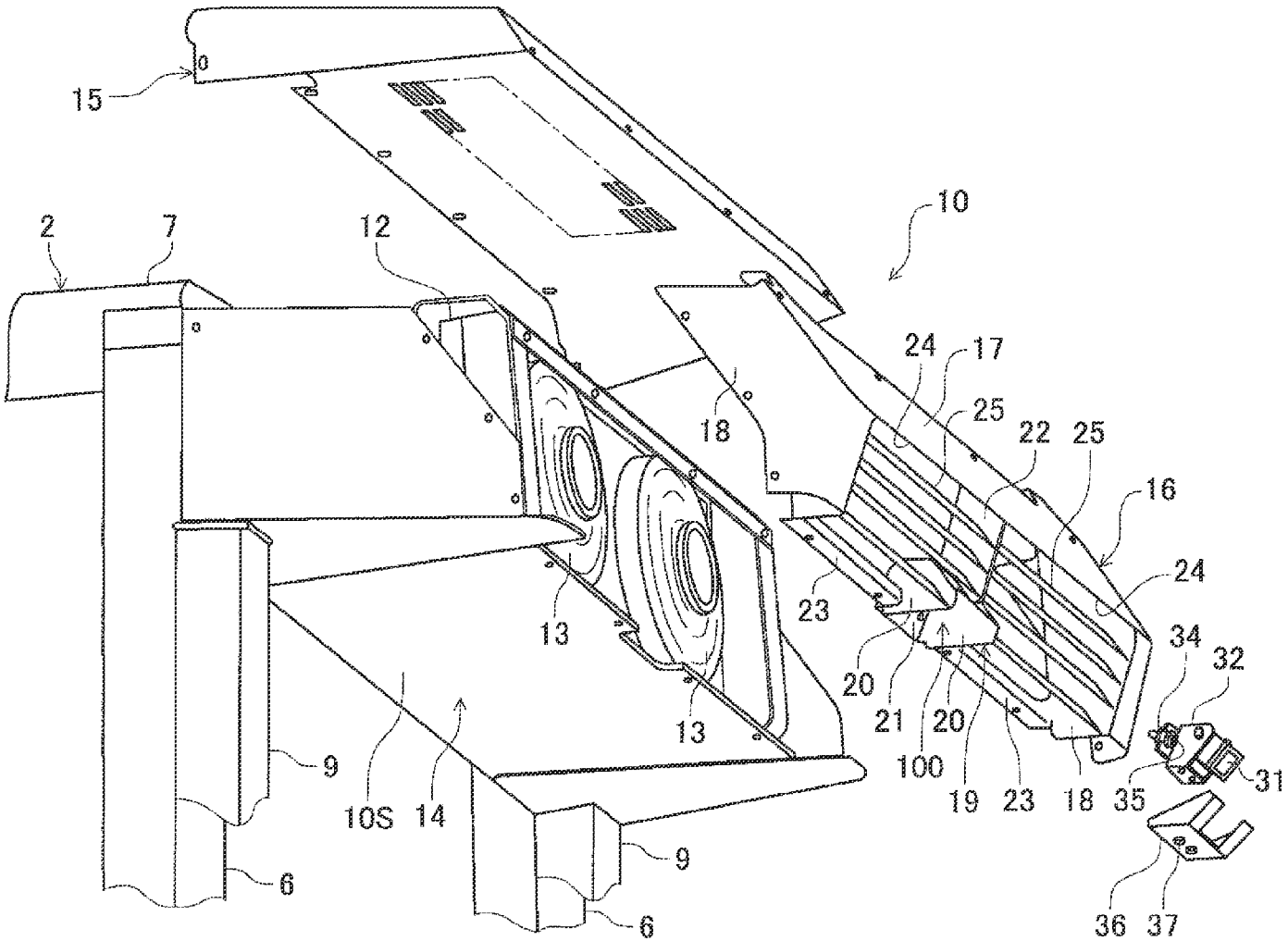
FIG. 5 is an exploded perspective view of an air conditioner casing.

As illustrated in FIG. 5, the air conditioner casing 10 includes an air conditioner casing body 14 fixed to the right and left rear pillars 6. The air conditioner casing body 14 is opened upwards and rearwards, respectively. Further, a hood 15 and a blower part cover 16 are respectively detachably attached to the air conditioner casing body 14, the hood 15 herein covers the upwardly opened part of the air conditioner casing body 14, while the blower part cover 16 covers the backwardly opened part of the air conditioner casing body 14.

As illustrated in FIG. 2, the air conditioner casing 10 herein includes a bottom face 10S and a recess 100 opened towards the bottom face 10S. The bottom face 10S is roughly horizontally disposed rearwards of the cab 2. The bottom face 10S includes a bottom face of the air conditioner casing body 14 and that of the blower part cover 16. The recess 100 is formed on the bottom face of the blower part cover 16 which forms a part of the bottom face 105. The recess 100 forms a space for incorporating therein a rear monitoring camera apparatus 30 to be described, and accommodates at least a main body 31*a* of a rear monitoring camera 31 (see FIG. 5). The inner wall of the recess 100 is formed by a wind shielding cover 19 to be described. Thus, the air conditioner casing 10 according to the present embodiment forms a support structure of the rear monitoring camera apparatus 30.

Explanation of Blower Part Cover

The blower part cover 16 covers the two sets of the cooling fans 13 and forms a wind path for the blown wind Q produced by the cooling fans 13. The blower part cover 16 includes a top face plate 17 upwardly slanted to the forward. Further, a pair of side plates 18, downwardly extended, is connected to the right and left edge portions of the top face plate 17. Yet further, the wind shielding cover 19 is disposed transversely in the middle of the right and left side plates 18.

Explanation of Wind Shielding Cover

The wind shielding cover 19 is a cup-shaped cover opened downwards and partially rearwards, and forms the recess 100 within the blower part cover 16. The wind shielding cover 19 is formed by right and left side plates 20 and an upper plate 21 which has a cross-section of a roughly inverted U shape and connects the top edge portions of the right and left side plates 20.

The upper plate 21 of the wind shielding cover 19 and the top face plate 17 of the blower part cover 16 are connected by a partitioning plate 22 which divides a space produced between the right and left side plates 18 in the blower part cover 16 into right and left halves. Further, the right and left side plates 20 of the wind shielding cover 19 and the right and left side plates 18 of the blower part cover 16 are connected by a tight and left beam members 23.

Where the blower part cover 16 is attached to the air conditioner casing body 14, the wind shielding cover 19 is positioned between the two sets of the cooling fans 13 without being overlapped therewith as illustrated in FIG. 4 (a view seen in a direction of an arrow B of FIG. 2, i.e., a planar view of the rear upper part of the cab 2). More accurately expressed, the wind shielding cover 19 is positioned right below a center position M arranged between the rotation shafts R of the cooling fans 13 in the planar view of the rear upper part of the cab 2. Thus, the wind shielding cover 19 is positioned lower than the respective rotation shafts R of the cooling fans 13 while being disposed transversely in the middle of the rotation shafts R.

Explanation of Blower Port in Blower Part Cover

Figure 3B:
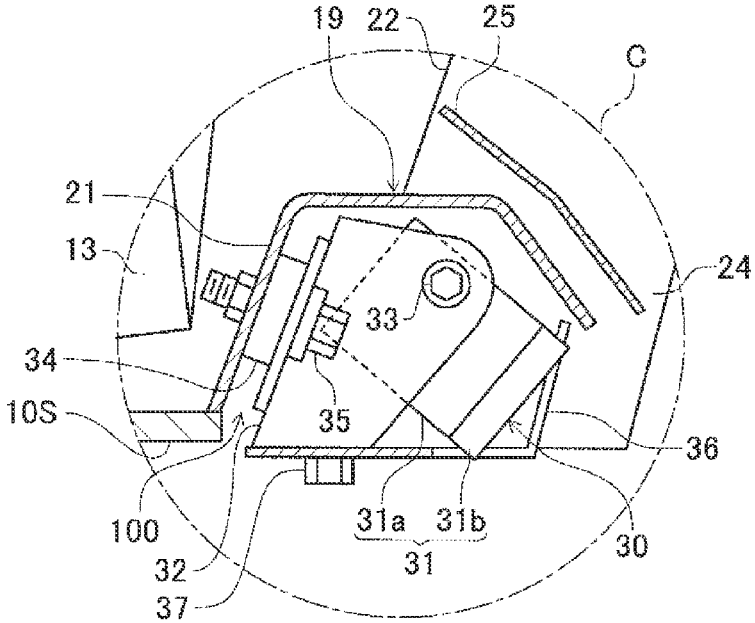
FIG. 3B is an enlarged view of a part C of 3A.

As illustrated in FIG. 5, the blower part cover 16 includes openings enclosed by the top face plate 17, the side plates 18, the partitioning plate 22, the wind shielding cover 19 and the beam members 23, and the openings function as blower openings 24. As illustrated in FIG. 3A and FIG. 3B, the blown wind Q produced by the cooling fans 13 is backwardly blown out of the blower openings 24 in an obliquely downward direction. It should be noted that the blower openings 24 are respectively provided with flow guide plates 25 required for guiding the flow of the blown wind Q.

Explanation of Rear Monitoring Camera Apparatus

As illustrated in FIGS. 3A and 3B, the rear monitoring camera apparatus 30 is incorporated within the wind shielding cover 19.

As illustrated in FIGS. 3B and 5, the rear monitoring camera apparatus 30 is formed by the rear monitoring camera 31 which is configured to monitor the back of the bulldozer 1 and a bracket 32 which supports the rear monitoring camera 31 for adjusting the angle of the rear monitoring camera 31 in the vertical direction.

As illustrated in FIG. 3B, which is a longitudinal cross-sectional view (i.e., a cross-sectional side view) of the blower part cover 16, the rear monitoring camera apparatus 30 is disposed within the blower part cover 16 without being substantially protruded downwards from a position defined by the bottom face of the air conditioner casing body 14 (i.e., the bottom face of the blower part cover 16 in the present embodiment).

Explanation of Rear Monitoring Camera

As illustrated in FIG. 3B, the rear monitoring camera 31 is formed by the main body 31 (corresponds to "a main body of a rear monitoring camera" of the present invention) which is embedded with components such as an image analyzer circuit and a lens part 31*b* which is attached to the tip side of the main body 31*a* for capturing light from a photographic subject. The main body 31*a* is fixed to the bracket 32 by fastening a bolt 33 thereto while the lens part 31*b* is tilted at an appropriate angle in a rear downward direction of the bulldozer 1.

The main body 31*a* of the rear monitoring camera 31 is herein completely covered with the wind shielding cover 19, and the wind shielding cover 19 shields against the blown wind Q directed from the cooling fans 13 to the rear monitoring camera 31. It is thereby possible to reliably inhibit elevation of the temperature of the rear monitoring camera 31 due to the impact of the blown wind Q heated as a result of heat exchange with the condenser 12.

Explanation of Mounting Structure of Rear Monitoring Camera

The bracket 32 for supporting the rear monitoring camera 31 is fixed to the wind shielding cover 19 by fastening bolts 35 thereto while an anti-vibration rubber 34 is interposed between the bracket 32 and the upper plate 21 of the wind shielding cover 19.

With the structure of attaching the rear monitoring camera apparatus 30 to the wind shielding cover 19 through the anti-vibration rubber 34, the anti-vibration rubber 34 can inhibit not only transmission of vibration from the cab 2 side to the rear monitoring camera apparatus 30 but also thermal transmission to the rear monitoring camera apparatus 30 from the wind shielding cover 19 warmed due to the impact of the blown wind Q produced by the cooling fans 13. Further, an air layer is produced between the wind shielding cover 19 and the rear monitoring camera apparatus 30 by means of the anti-vibration rubber 34 interposed therebetween. Therefore, it is possible to more reliably inhibit elevation of the temperature of the rear monitoring camera apparatus 30.

Explanation of Under Cover of Rear Monitoring Camera Apparatus

It should be noted that an under cover 36 is fixed to the bracket 32 supporting the rear monitoring camera 31 by fastening bolts 37 thereto. The under cover 36 serves to cover the downwardly opened part of the wind shielding cover 19 where the rear monitoring camera 31 is attached to the wind shielding cover 19 by means of the aforementioned attachment structure.

Explanation of Advantageous Effects of Present Embodiment

According to the present embodiment, in the blower part cover 16, at least the main body 31*a* of the rear monitoring camera 31 is accommodated within the wind shielding cover 19 forming the recess 100, therefore, the rear monitoring camera 31 does not block a rear field of view and has less chances of damage by external obstacles.

When the wind shielding cover 19 is accommodated within the blower part cover 16, the wind shielding cover 19 blocks the flow of the blown wind Q from the cooling fans 13, and then there is the threat of reduction in the flow amount of the blown wind Q blown out of the blower part cover 16. According to the present embodiment, by contrast, the wind shielding cover 19 is positioned between the two sets of the cooling fans 13 as illustrated in FIG. 4, therefore, the wind shielding cover 19 does not block the flow of the blown wind Q from the cooling fans 13. Consequently, reduction in the flow amount of the blown wind Q can be inhibited.

Other Embodiments

The work vehicle equipped with the rear monitoring camera apparatus of the present invention has been explained based on an embodiment. However, the present invention is not limited to the structure of the aforementioned embodiment, and a variety of changes can be arbitrarily made for the structure without departing from the scope of the present invention.

For example, the aforementioned embodiment provides the exemplary aspect that two sets of the cooling fans 13 are disposed for cooling down the condenser 12. However, it is herein possible to provide an exemplary aspect of disposing three or more sets of the cooling fans 13. Even in this case, it is obvious to dispose the wind shielding cover 19 between any two adjacent sets of the cooling fans 13 in order to cover the main body of the rear monitoring camera 31.

Further, the aforementioned embodiment provides the exemplary aspect that the wind shielding cover 19 is integrally disposed with the blower part cover 16. However, it is herein possible to provide an exemplary aspect of separately disposing the wind shielding cover 19 from the blower part cover 16. For example, the wind shielding cover 19 is herein fixed to the air conditioner casing body 14 by means of a fastening element such as a bolt.

Further, a variety of machines, including the indoor/outdoor air switching damper, the blower, the evaporator, the heater core and the air mix damper, are incorporated all together within the air conditioner unit 11 in the aforementioned embodiment. However, machines incorporated within the air conditioner unit 11 are not limited to the above. At least one of the aforementioned machines is herein only required to be incorporated within the air conditioner unit 11.

Figure 6:
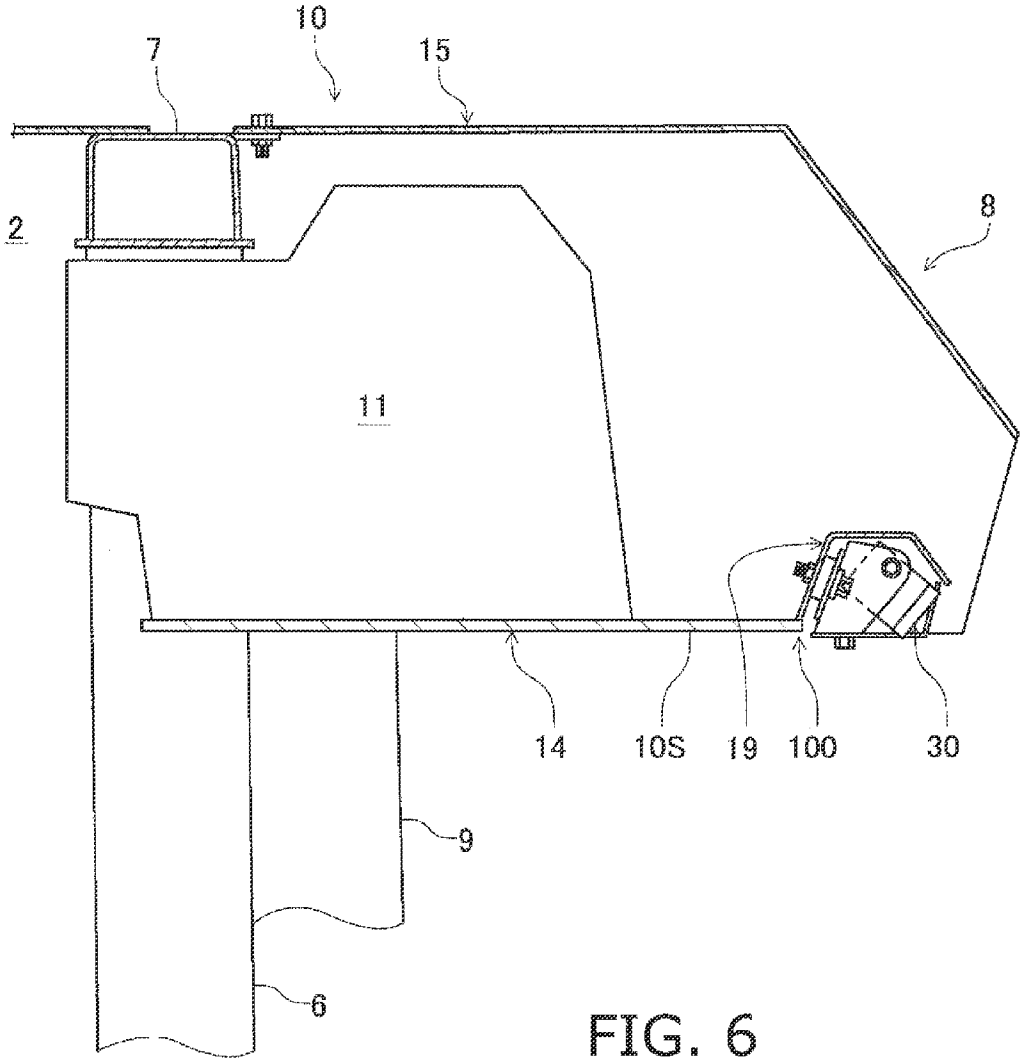
FIG. 6 is a cross-sectional view of a support structure of the rear monitoring camera apparatus.

Yet further, the air conditioner casing 10 accommodates the air conditioner unit 11, the condenser 12 and the cooling fans 13 in the aforementioned embodiment. However, components accommodated in the air conditioner casing 10 are not limited to the above. For example, the air conditioner casing 10 may accommodate only the air conditioner unit 11 as illustrated in FIG. 6. Alternatively, the air conditioner casing 10 may accommodate some of the devices forming the air conditioner 8, for instance, only the condenser 112 and the cooling fans 13. Even in this case, a desired advantageous effect can be achieved by incorporating the rear monitoring camera apparatus 30 into the recess 100 formed on the bottom face 10S of the air conditioner casing 10.

According to the work vehicle of the present invention, the rear monitoring camera apparatus is characterized in that it does not block a rear field of view and has less chances of damage by external obstacles. Therefore, the rear monitoring camera apparatus can be preferably used for the work vehicles (e.g., bulldozers) including an air conditioner attached to the rear upper part of a cab.

What is claimed is:

1. A work vehicle, comprising:

a cab;

an air conditioner casing attached to a rear upper part of the cab, the air conditioner casing including a recess opening on a bottom face;

an air conditioner unit and a first cooling fan accommodated in the air conditioner casing; and a rear monitoring camera including a main body accommodated in the recess of the air conditioner casing, the air conditioner casing including a blower part cover forming a wind path of blown wind from the first cooling fan, and the blower part cover including a wind shielding cover, the wind shielding cover forming an inner wall of the recess, the wind shielding cover covering the main body of the rear monitoring camera for shielding against the blown wind.

2. The work vehicle according to claim 1, further comprising a condenser accommodated in the air conditioner casing, the condenser disposed along a transverse direction of the work vehicle, and a second cooling fan accommodated in the air conditioner casing, the second cooling fan being disposed adjacent to the first cooling fan in the transverse direction, wherein the blower part cover covers rear sides of the first and second cooling fans, the blower part cover forming a wind flow path for blown wind from the first and second cooling fans.

3. The work vehicle according to claim 2, wherein the wind shielding cover is disposed in a clearance between the first and second cooling fans without being overlapped with the first and second cooling fans when transparently viewed from a rear side.

4. The work vehicle according to claim 3, wherein each of the first and second cooling fans includes a rotation shaft disposed along a longitudinal direction of the work vehicle, and the rear monitoring camera is positioned lower than the rotation shafts of the first and second cooling fans in a vertical direction of the work vehicle, the rear monitoring camera being disposed in the middle of the rotation shafts of the first and second cooling fans in the transverse direction.

5. The work vehicle according to claim 3, wherein the rear monitoring camera is attached to the wind shielding cover through an anti-vibration rubber.

6. The work vehicle according to claim 4, wherein the rear monitoring camera is attached to the wind shielding cover through an anti-vibration rubber.

* * * * *